US006886301B2

(12) United States Patent
Schilger

(10) Patent No.: US 6,886,301 B2
(45) Date of Patent: May 3, 2005

(54) EXTERIOR BUILDING CLADDING HAVING RIGID FOAM LAYER WITH DRAIN CHANNELS

(76) Inventor: Herbert K. Schilger, 1326 - 20th Avenue N.W., Calgary (CA), T2M 1G3

( * ) Notice: Subject to any disclaimer, the term of this patent is extended or adjusted under 35 U.S.C. 154(b) by 0 days.

(21) Appl. No.: 10/802,724

(22) Filed: Mar. 18, 2004

(65) Prior Publication Data

US 2004/0200171 A1 Oct. 14, 2004

Related U.S. Application Data

(63) Continuation-in-part of application No. 10/411,305, filed on Apr. 11, 2003.

(51) Int. Cl.[7] ..... E04F 17/08

(52) U.S. Cl. ..... 52/302.1; 52/302.3; 52/309.11; 52/309.4; 52/481.1; 52/586.1; 52/404.1; 52/309.12

(58) Field of Search ..... 52/302.1, 302.3, 52/309.11, 309.12, 309.4, 481.1, 586.1, 404.1, 506.1, 782.1, 602, 404.4, 169.5

(56) References Cited

U.S. PATENT DOCUMENTS 3,511,007 A * 5/1970 Babcock ..... 52/309.8
3,965,635 A 6/1976 Renkert ..... 52/434
4,103,467 A * 8/1978 Lindal ..... 52/404.1
4,856,244 A 8/1989 Clapp ..... 52/309.7
5,522,194 A * 6/1996 Graulich ..... 52/309.4
5,540,022 A * 7/1996 Morris ..... 52/309.8
5,758,463 A 6/1998 Mancini ..... 52/309.12
6,622,452 B2 * 9/2003 Alvaro ..... 52/742.14
6,715,249 B2 * 4/2004 Rusek et al. ..... 52/481.1
6,729,090 B2 * 5/2004 Messenger et al. ..... 52/309.12

* cited by examiner

*Primary Examiner*—Carl D. Friedman
*Assistant Examiner*—Nahid Amiri

(57) ABSTRACT

A novel building construction is described for exterior building walls. The construction comprises an interior frame formed of a plurality of laterally spaced studs or beams, a layer of rigid insulation adjacent to the exterior side of this steel frame, exterior building cladding adjacent the exterior side of the rigid insulation and a plurality of low conductivity connectors, e.g. insulating plastic connectors or thin metal strips having an insulating plastic foam coating, extending through the layer of rigid insulation and connecting together the exterior cladding and the interior steel studs or beams. Vertical channels are formed adjacent both the inside and outside faces of the insulation layer to remove moisture. This provides the required structural strength with a minimum of thermal conductivity from the warm side to the cold side of the building envelope, while providing exterior drain channels and interior moisture removing channels.

17 Claims, 3 Drawing Sheets

EXTERIOR BUILDING CLADDING HAVING RIGID FOAM LAYER WITH DRAIN CHANNELS

CROSS-REFERENCE TO RELATED APPLICATION

This application is a continuation-in-part of application Ser. No. 10/411,305, filed Apr. 11, 2003.

BACKGROUND OF THE INVENTION

This invention relates to building construction and more particularly to a building wall construction having an interior frame work and exterior cladding.

Particularly in colder climates, it has been a common building technique for many years to construct an interior support frame, with an exterior wall cladding or shell fixed to the exterior side of the frame and an interior wall fixed to the interior side of the frame. Many different materials have been used for the exterior wall cladding, including brick veneer, aluminum siding, vinyl siding, wood siding, stucco, concrete, glass, metal, etc. Such constructions may be made with or without insulating materials.

The frame is typically made of wood or steel and frames made of steel studs and beams are now becoming more commonplace even for home construction. It is also commonplace to use metal connectors for connecting the exterior wall cladding to the frame and these may be in the form of screws, bolts, clips, protruding lugs, etc. Particularly when a steel frame is used, when there is a difference between exterior and interior temperatures, there tends to be condensation and subsequent corrosion along the connector from the cold exterior cladding to the warm interior wall cavity of the building. Even when rigid thermal insulation is used between the exterior cladding and the structural frame, this problem of condensation and corrosion may continue through the insulation along the structural connector.

It is an object of the present invention to provide a thermally non-conducting connection between the exterior cladding and the interior frame of the building wall to thereby break the bridge between the different temperature areas and also to remove any interior condensation and collected rain water.

SUMMARY OF THE INVENTION

The present invention in its broadest aspect relates to a building wall construction comprising an interior frame formed of a plurality of laterally spaced studs or beams, a layer of rigid insulation adjacent the exterior side of the frame and an interior wall connected to the interior side of the frame with the rigid insulation layer and interior wall forming a wall cavity therebetween. Vertical channels are formed in the rigid insulation layer adjacent the interior side thereof for collecting and removing moisture from the wall cavity and vertical channels are formed in the rigid insulation adjacent the exterior side thereof for collecting and removing rain water. An exterior building cladding is provided adjacent the exterior side of the rigid insulation and a plurality of low thermal conductivity connectors extend through the layer of rigid insulation and connect the exterior cladding to the interior frame.

The frame is typically made with wood or metal studs, e.g. galvanized sheet steel channels. The rigid insulation is typically made of plastic foam, e.g. polystyrene foam.

The exterior wall cladding may be any of the exterior wall claddings that are traditionally used. These may include, for example, brick veneer, wood siding, aluminum siding, vinyl siding, stucco, concrete, glass, metals, etc.

In one embodiment the low conductivity connectors can be insulating plastic connectors can be made from a variety of plastic materials having high strength and an ability to withstand high variations in temperature. High strength polyolefins, such as polyethylene or polypropylene are particularly useful. The connectors are typically made of plastic material having a form of relatively thin bands. The material may be either flexible or rigid.

In a further embodiment the low conductivity connector may be in the form of a composite strip comprising a thin metal strip, e.g. galvanized sheet metal, with at least the portion of the metal strip that projects to the outside of the rigid foam insulation being encased with a layer of high density, closed cell plastic foam material. This provides added security against structural failure of connectors made entirely of plastic material, while preventing outside cold from being conducted by the metal strip through the rigid insulation layer.

In passing through the rigid insulation layer, the low conductivity connector should fit snugly within an opening in the rigid insulation through which it passes. This can conveniently be accomplished by providing the connector with a sharpened tip which can simply be pushed through the insulation, creating its own opening.

The inner end of each low conductivity connector can be connected to a frame component by a variety of means and can be very simply connected by means of screws. The outer end of each low conductivity connector may be connected to the building cladding in a number of different ways which will be described hereinafter.

BRIEF DESCRIPTION OF THE DRAWINGS

In the drawings which illustrate certain preferred embodiments of this invention.

DESCRIPTION OF THE PREFERRED EMBODIMENTS

Figure 1:
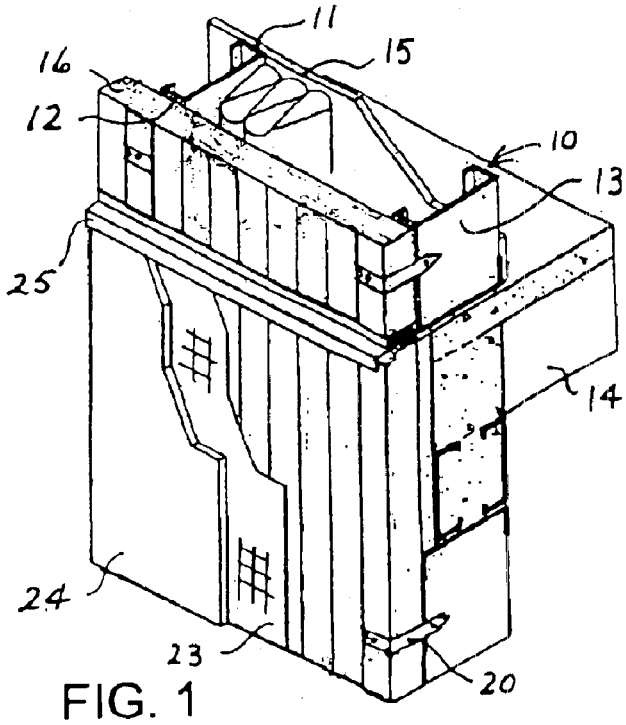
FIG. 1 is an isometric view of a wall construction according to the invention.
Figure 2:
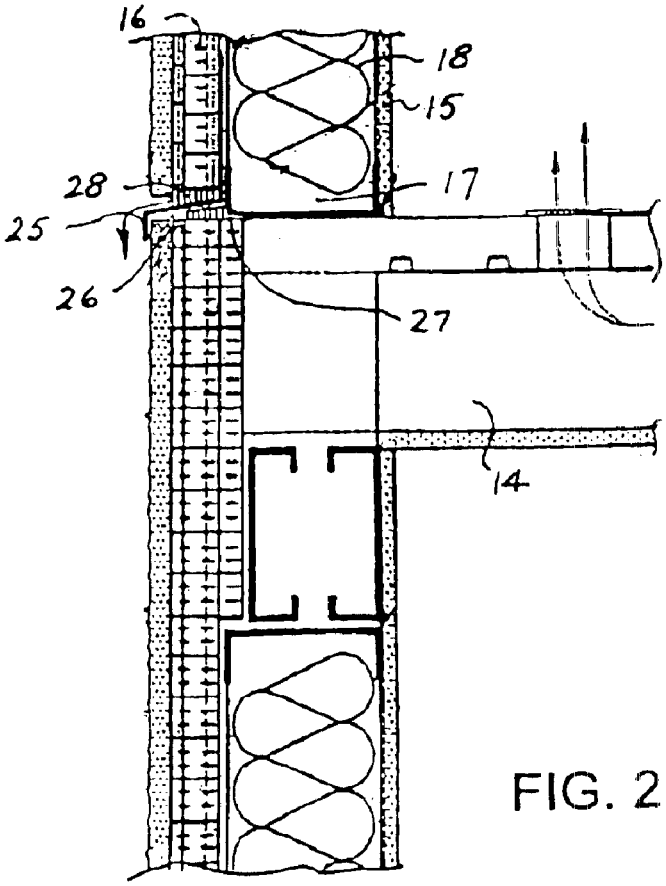
FIG. 2 is a sectional elevation of a wall construction according to the invention.

As seen in FIGS. 1 and 2, this construction according to the present invention includes an interior framework formed of steel studs 10. Each stud has an inner flange 11, an outer flange 12 and a central web 13. Floor beams 14 intersect the wall frame portions.

A standard wall paneling 15 is connected to inner flanges 11 of studs 10 and panels of rigid foam insulation 16 are placed adjacent the outer face of the outer flange 12 of studs 10. The inner wall panels and the foam panels form therebetween the wall cavity 17 that is fill with commercial insulation 18, e.g. glass fiber batts.

The rigid foam panels 16 are connected to the studs 10 by way of plastic connectors 20 one type of which can be seen in FIG. 1. In the particular embodiment of FIGS. 1 and 2, a metal mesh stucco lath 23 is applied over the rigid foam panels 16 and over the lath is applied an exterior stucco coating 24.

The wall structures are horizontally separated at each floor level of a structure as can be seen in FIG. 2. A downwardly sloping metal flashing 25 is installed between the two sections for draining away any water.

Figure 3:
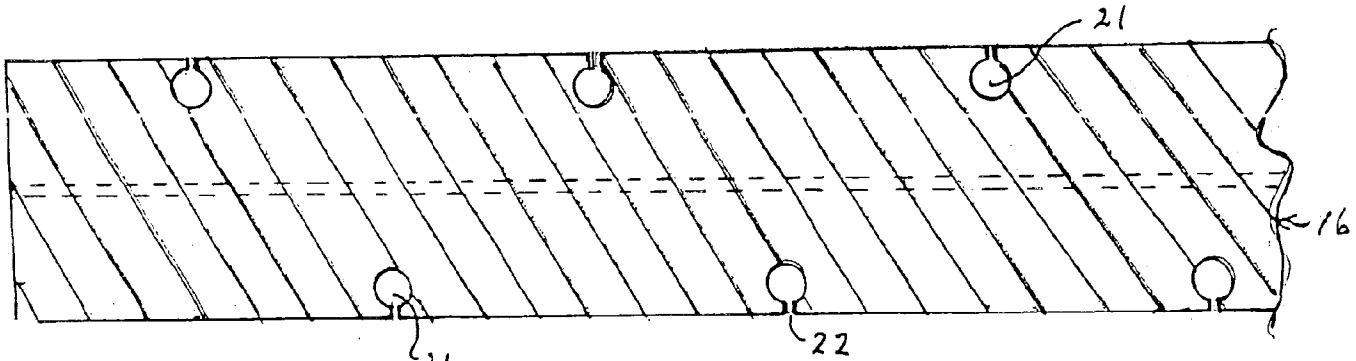
FIG. 3 is a horizontal section through a rigid foam panel of the invention.
Figure 4:
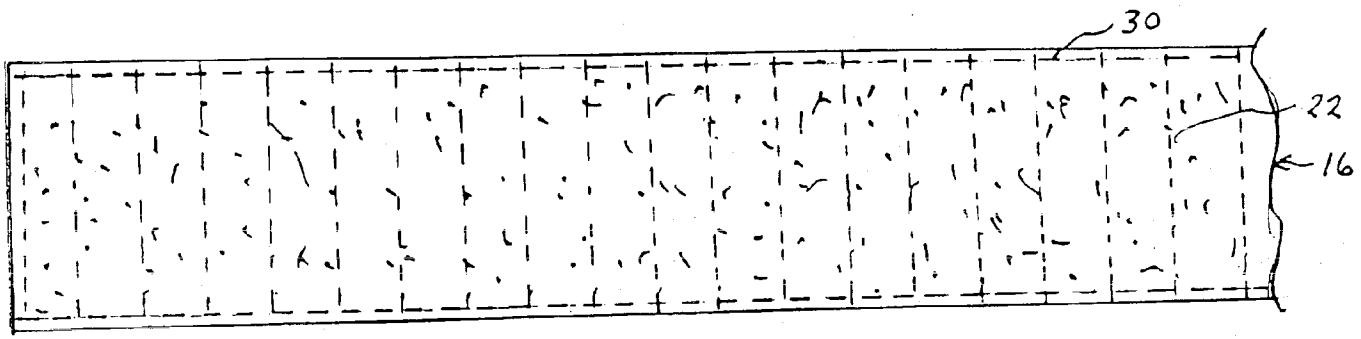
FIG. 4 is an elevation view of a valid form panel.
Figure 5:
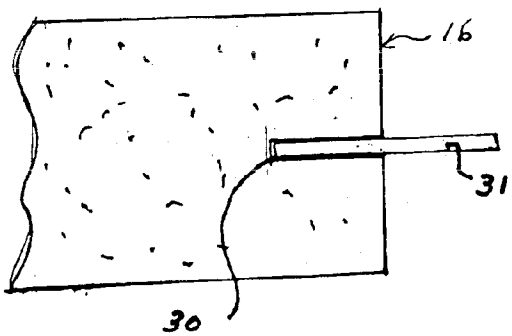
FIG. 5 is an elevation showing a detail of connector slot in the rigid form panel.

Details of the rigid foam panels 16 can better be seen from FIGS. 3, 4 and 5 and these are preferably formed from panels having a thickness of about 2 inches. Vertical channels 21 are formed in the foam panels adjacent both the interior and exterior sides of the rigid foam panels 16 and connect to the exterior by way of thin channels 22.

The vertical channels in the exterior face of the rigid foam panels provides a rain screen at the interface between the stucco and the rigid insulation. Exterior water penetration drains to the bottom of the channel and exists via a drain wick 28 and flashing 25.

Vapour that may collect in the wall cavity is vented by way of the channels on the inside face of the rigid insulation panels. This vaporizes up through the channels and exits through the vents 26 as well as through weep holes 27.

The solid insulation panels also have grooves or slots 30, cut into the edge faces to allow a positive connection all around each panel by means of plastic splines inserted between the panels. These plastic splines may also be made from a polyolefin plastic such as polyethylene or polypropylene. A combination of the rigid foam panels, the plastic connectors extending through the foam panels and the plastic splines connecting the foam panels edge to edge together create a complete insulating envelope free of any thermal bridging between the interior and exterior of the building. The plastic splines when inserted in the slots 30 form a rigid lateral support between the studs. As part of this lateral strengthening, screws may extend through the splines and into the studs.

Figure 6:
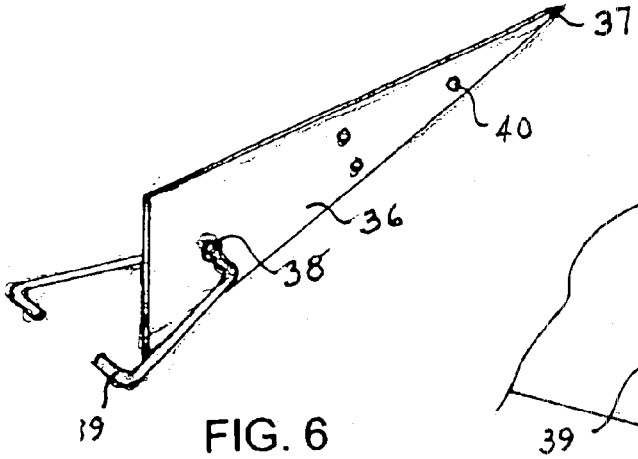
FIG. 6 is a perspective view of a plastic connector for brick facing.
Figure 7:
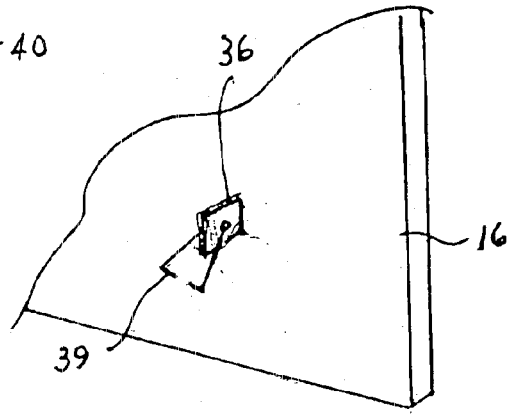
FIG. 7 is a perspective view of a plastic connector passing through a foam panel.

Details of some forms of plastic connectors can be seen in FIGS. 6 to 9. The plastic connector 36 of FIG. 6 is in the form of a wedge with a sharp tip 37 for penetrating a foam panel 16. The connector 36 has holes 40 for connecting to interior studs and an inner hole 38 containing a steel loop 39 which becomes embedded in a mortar joint between bricks thereby locking a brick outer shell to the frame.

Figure 8:
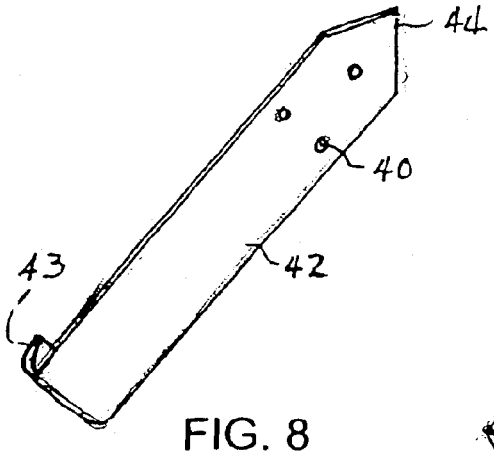
FIG. 8 is a perspective view of a plastic connector for stucco lath.

FIG. 8 shows a further form of plastic connector strip used for connecting stucco lath mesh. This strip 42 has a sharp point 44, connector holes 40 and a loop portion 43 which loops around and holds the stucco lath mesh.

Figure 9:
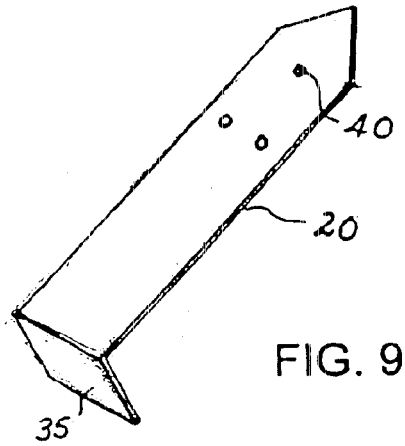
FIG. 9 is a perspective view of a general purpose plastic connector.

The connector of FIG. 9 can be used for a variety of purposes having a perpendicular end flange 35. This is the flange shown in use in FIG. 1.

Figure 10:
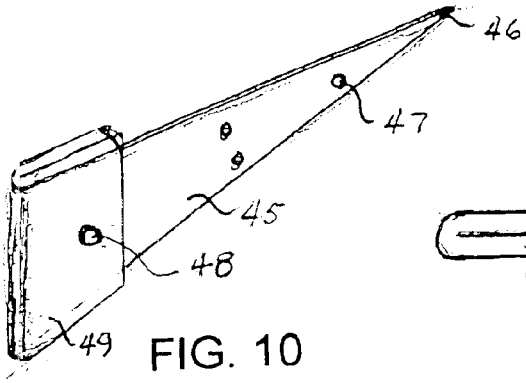
FIG. 10 is a perspective view of a sheet metal/plastic foam connector.
Figure 11:
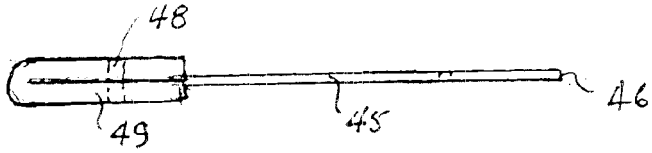
FIG. 11 is a top view of the connector of FIG. 10.

FIGS. 10 and 11 show an alternative form of connector which is a wedge shaped galvanized sheet steel member 45 having a similar shape to plastic connector 36. The sheet steel member 45 has a sharp tip 46 for penetrating a foam panel 16 and has holes 47 for connecting to interior studs. A hole 48 is adapted to receive a connector loop 39.

Surrounding the outer end of steel member 45 that does not penetrate the foam panel 16 is a layer 49 of high density, closed cell plastic foam. This foam layer 49 is wrapped around and fully encloses the outer end of steel member 45.

The foam layer can be made of a variety of commercial materials, such as ethyl vinyl acetate, cross-linked polyethylene, etc., and is available in sheet form having an adhesive on one face. The high density, closed cell foam provides good strength, high R-value and is resistant to water penetration. It is highly effective in preventing outside cold from being conducted by the steel member through the foam sheet 16.

It will be understood that the wall construction of this invention can be used with any exterior building cladding, including brick, stucco or siding, e.g. wood, metal or vinyl siding. For the mounting of the siding vertical furring strip are typically used which are attached, e.g. by screws, to horizontal plastic splines 31 inserted between the rigid foam insulation panels.

The present invention is not limited to the embodiment disclosed and the right is reserved to make variations and modifications in the invention that do not depart from the spirit of scope thereof as herein defined by the appended claims.

What is claimed is:

1. A building wall construction comprising an interior frame formed of a plurality of laterally, spaced studs or beams, a layer of rigid foam insulation adjacent the exterior side of said frame and an interior wall connected to the interior side of the frame with the rigid insulation layer and interior wall forming a wall cavity therebetween, vertical venting channels formed on the interior side of said rigid insulation layer for collecting and removing moisture from the wall cavity and vertical venting channels formed on the exterior side of said rigid foam insulation for collecting and removing rain water, exterior building cladding adjacent the exterior side of said rigid foam insulation and a plurality of thin, low conductivity connectors extending through said layer of rigid foam insulation and connecting said exterior cladding to said studs or beams.

2. A wall construction according to claim 1 wherein the low conductivity connector comprises a thin band or low conductivity plastic material.

3. A wall construction according to claim 2 wherein the low conductivity connector comprises a thin metal strip having the portion thereof extending to the outside of the rigid foam insulation covered with a layer of high density, closed cell plastic foam.

4. A wall construction according to claim 1 wherein the interior frame is formed of wood or steel studs.

5. A wall construction according to claim 4 wherein the rigid foam insulation is in the form of panels having a thickness of about 1 to 3 inches.

6. A wall construction according to claim 5 wherein the rigid foam insulation panels are joined edge to edge by means of edge slots containing plastic splines.

7. A wall construction according to claim 6 wherein screws extend through the splines and into the studs.

8. A wall construction according to claim 6 wherein the vertical venting channels are laterally spaced by a distance of about 2 to 4 inches.

9. A wall construction according to claim 2 wherein the plastic connectors are flexible plastic straps.

10. A wall construction according to claim 2 wherein the plastic connectors are rigid plastic strips.

11. A wall construction according to claim 10 wherein the rigid plastic strips have sharp points capable of piercing the rigid insulation.

12. A wall construction according to claim 2 wherein the low conductivity plastic material is formed of polyolefin.

13. A wall construction according to claim 12 wherein the polyolefin is polypropylene or polyethylene.

14. A wall construction according to claim 1 wherein the low conductivity connectors are joined to the studs by means of screws.

15. A wall construction according to claim 1 wherein the exterior cladding is stucco on a metal mesh lath and the low conductivity connectors have loop portions which hook onto the metal mesh.

16. A wall construction according to claim 1 wherein the exterior cladding is bricks and the low conductivity connectors are joined to the bricks by means of metal brick ties extending from the outer ends of the low conductivity connectors into the bricks.

17. A wall construction according to claim 1 wherein the exterior cladding is siding connected to vertical furring strips which are connected to horizontal plastic splines.

* * * * *